US010662542B2

(12) United States Patent
Caldwell et al.

(10) Patent No.: US 10,662,542 B2
(45) Date of Patent: May 26, 2020

(54) MATERIAL AND PROCESS FOR ELECTROCHEMICAL DEPOSITION OF NANOLAMINATED BRASS ALLOYS

(71) Applicant: Modumetal, Inc., Seattle, WA (US)

(72) Inventors: Richard Caldwell, Lynnwood, WA (US); Jesse Unger, Bellevue, WA (US)

(73) Assignee: MODUMETAL, INC., Seattle, WA (US)

( * ) Notice: Subject to any disclaimer, the term of this patent is extended or adjusted under 35 U.S.C. 154(b) by 211 days.

(21) Appl. No.: 15/640,401

(22) Filed: Jun. 30, 2017

(65) Prior Publication Data

US 2018/0016692 A1 Jan. 18, 2018

Related U.S. Application Data

(60) Division of application No. 13/747,020, filed on Jan. 22, 2013, now Pat. No. 9,732,433, which is a (Continued)

(51) Int. Cl.

| | |
|---|---|
| ***C25D 3/56*** | (2006.01) |
| ***C25D 5/48*** | (2006.01) |
| ***C25D 1/00*** | (2006.01) |
| ***C25D 3/58*** | (2006.01) |
| ***C25D 5/10*** | (2006.01) |
| ***C25D 5/18*** | (2006.01) |
| ***C25D 5/56*** | (2006.01) |
| ***C25D 5/54*** | (2006.01) |
| *C23C 18/16* | (2006.01) |

(52) U.S. Cl.

CPC ..... *C25D 3/56* (2013.01); *C25D 1/00* (2013.01); *C25D 3/58* (2013.01); *C25D 5/10* (2013.01); *C25D 5/18* (2013.01); *C25D 5/48* (2013.01); *C25D 5/54* (2013.01); *C25D 5/56* (2013.01); *C23C 18/1653* (2013.01); *Y10T 428/12569* (2015.01); *Y10T 428/12639* (2015.01)

(58) Field of Classification Search

None

See application file for complete search history.

(56) References Cited

U.S. PATENT DOCUMENTS

| | | | |
|---|---|---|---|
| 2,470,775 | A | 5/1949 | Jernstedt et al. |
| 2,642,654 | A | 6/1953 | Ahrens |

(Continued)

FOREIGN PATENT DOCUMENTS

| | | |
|---|---|---|
| EP | 1 826 294 A1 | 8/2007 |
| JP | S47-002005 | 2/1972 |

(Continued)

OTHER PUBLICATIONS

Adams et al., "Controlling strength and toughness of multilayer films: A new multiscalar approach," J. Appl. Phys. 74 (2) Jul. 15, 1993, 1015-1021.

(Continued)

*Primary Examiner* — Daniel J. Schleis

(74) *Attorney, Agent, or Firm* — Seed Intellectual Property Law Group LLP

(57) ABSTRACT

Described herein are methods of preparing nanolaminated brass coatings and components having desirable and useful properties. Also described are nanolaminated brass components and plastic and polymeric substrates coated with nanolaminated brass coatings having desirable and useful properties.

25 Claims, 6 Drawing Sheets

Related U.S. Application Data continuation of application No. PCT/US2011/045128, filed on Jul. 22, 2011.

(60) Provisional application No. 61/366,924, filed on Jul. 22, 2010.

(56) References Cited

U.S. PATENT DOCUMENTS

| | | | |
|---|---|---|---|
| 2,678,909 | A | 5/1954 | Jernstedt et al. |
| 2,694,743 | A | 11/1954 | Ruskin et al. |
| 2,706,170 | A | 4/1955 | Marchese |
| 3,359,469 | A | 12/1967 | Levy et al. |
| 3,549,505 | A | 12/1970 | Hanusa |
| 3,616,286 | A | 10/1971 | Aylward et al. |
| 3,633,520 | A | 1/1972 | Stiglich, Jr. |
| 3,716,464 | A | 2/1973 | Kovac et al. |
| 3,753,664 | A | 8/1973 | Klingenmaier et al. |
| 3,759,799 | A | 9/1973 | Reinke |
| 3,787,244 | A | 1/1974 | Schulmeister et al. |
| 4,053,371 | A | 10/1977 | Towsley |
| 4,107,003 | A | 8/1978 | Anselrode |
| 4,204,918 | A | 5/1980 | McIntyre et al. |
| 4,246,057 | A | 1/1981 | Janowski et al. |
| 4,422,907 | A | 12/1983 | Birkmaier et al. |
| 4,543,803 | A | 10/1985 | Keyasko |
| 4,591,418 | A | 5/1986 | Snyder |
| 4,592,808 | A | 6/1986 | Doubt |
| 4,597,836 | A | 7/1986 | Schaer et al. |
| 4,620,661 | A | 11/1986 | Slatterly |
| 4,652,348 | A | 3/1987 | Yahalom et al. |
| 4,666,567 | A | 5/1987 | Loch |
| 4,702,802 | A | 10/1987 | Umino et al. |
| 4,795,735 | A | 1/1989 | Liu et al. |
| 4,834,845 | A | 5/1989 | Muko et al. |
| 4,839,214 | A | 6/1989 | Oda et al. |
| 4,869,971 | A | 9/1989 | Nee et al. |
| 4,904,543 | A | 2/1990 | Sakakima et al. |
| 4,923,574 | A | 5/1990 | Cohen |
| 5,045,356 | A | 9/1991 | Uemura et al. |
| 5,056,936 | A | 10/1991 | Mahrus et al. |
| 5,079,039 | A | 1/1992 | Heraud et al. |
| 5,156,899 | A | 10/1992 | Kistrup et al. |
| 5,268,235 | A | 12/1993 | Lashmore et al. |
| 5,300,165 | A | 4/1994 | Sugikawa |
| 5,320,719 | A | 6/1994 | Lasbmore et al. |
| 5,326,454 | A | 7/1994 | Engelhaupt |
| 5,352,266 | A | 10/1994 | Erb et al. |
| 5,431,800 | A | 7/1995 | Kirchhoff et al. |
| 5,489,488 | A | 2/1996 | Asai et al. |
| 5,545,435 | A | 8/1996 | Steffier |
| 5,660,704 | A | 8/1997 | Murase |
| 5,738,951 | A | 4/1998 | Goujard et al. |
| 5,798,033 | A | 8/1998 | Uemiya et al. |
| 6,036,832 | A | 3/2000 | Knol et al. |
| 6,071,398 | A | 6/2000 | Martin et al. |
| 6,284,357 | B1 | 9/2001 | Lackey et al. |
| 6,312,579 | B1 | 11/2001 | Bank et al. |
| 6,355,153 | B1 | 3/2002 | Uzoh et al. |
| 6,409,907 | B1 | 6/2002 | Braun et al. |
| 6,461,678 | B1 | 10/2002 | Chen et al. |
| 6,537,683 | B1 | 3/2003 | Staschko et al. |
| 6,547,944 | B2 | 4/2003 | Schreiber et al. |
| 6,739,028 | B2 | 5/2004 | Sievenpiper et al. |
| 6,800,121 | B2 | 10/2004 | Shahin |
| 6,884,499 | B2 | 4/2005 | Penich et al. |
| 6,908,667 | B2 | 6/2005 | Christ et al. |
| 6,979,490 | B2 | 12/2005 | Steffier |
| 9,005,420 | B2 | 4/2015 | Tomantschger et al. |
| 9,115,439 | B2 | 8/2015 | Whitaker |
| 9,234,294 | B2 | 1/2016 | Whitaker et al. |
| 9,732,433 | B2 | 8/2017 | Caldwell et al. |
| 9,758,891 | B2 | 9/2017 | Bao |
| 9,938,629 | B2 | 4/2018 | Whitaker et al. |
| 2003/0236163 | A1 | 12/2003 | Chaturvedi et al. |
| 2004/0027715 | A1 | 2/2004 | Hixson-Goldsmith et al. |
| 2004/0031691 | A1 | 2/2004 | Kelly et al. |
| 2004/0067314 | A1 | 4/2004 | Joshi et al. |
| 2004/0154925 | A1 | 8/2004 | Podlaha et al. |
| 2004/0178076 | A1 | 9/2004 | Stonas et al. |
| 2004/0239836 | A1 | 12/2004 | Chase |
| 2005/0205425 | A1 | 9/2005 | Palumbo et al. |
| 2005/0279640 | A1 | 12/2005 | Shimoyama et al. |
| 2006/0135281 | A1 | 6/2006 | Palumbo et al. |
| 2006/0135282 | A1 | 6/2006 | Palumbo et al. |
| 2006/0272949 | A1 | 12/2006 | Detor et al. |
| 2007/0158204 | A1 | 7/2007 | Taylor et al. |
| 2009/0155617 | A1 | 6/2009 | Kim et al. |
| 2009/0283410 | A1 | 11/2009 | Sklar et al. |
| 2012/0118745 | A1 | 5/2012 | Bao |
| 2015/0315716 | A1 | 11/2015 | Whitaker |
| 2018/0016694 | A1 | 1/2018 | Bao |
| 2018/0245229 | A1 | 8/2018 | Whitaker et al. |

FOREIGN PATENT DOCUMENTS

| | | | |
|---|---|---|---|
| JP | S47-33925 | A | 11/1972 |
| JP | S52-109439 | A | 9/1977 |
| JP | S58-193386 | A | 11/1983 |
| JP | S58-197292 | A | 11/1983 |
| JP | S60-97774 | B2 | 5/1985 |
| JP | S61-99692 | A | 5/1986 |
| JP | H06-196324 | A | 7/1994 |
| JP | 2000-239888 | A | 9/2000 |
| JP | 2006-035176 | | 2/2006 |
| JP | 2009-215590 | A | 9/2009 |
| WO | 83/02784 | A1 | 8/1983 |
| WO | 1997/00980 | A1 | 1/1997 |
| WO | 1997/039166 | A1 | 10/1997 |
| WO | 2007/021980 | A2 | 2/2007 |
| WO | 2007/082112 | A2 | 7/2007 |

OTHER PUBLICATIONS

Alfantazi et al., "Synthesis of nanocrystalline Zn—Ni alloy coatings", JMSLD5 15(15), 1996, 1361-1363.

Bakonyi et al., "Electrodeposited multilayer films with giant magnetoresistance (GMR): Progress and problems", Progress in Materials Science 55 (2010) 107-245.

Beattie et al., "Comparison of Electrodeposited Copper-Zinc Alloys Prepared Individually and Combinatorially," J. Electrochem. Soc., 150(11):C802-C806 (Sep. 25, 2003).

Blum, "The Structure and Properties of Alternately Electrodeposited Metals," paper presented at the Fortieth General Meeting of the American Electrochemical Society, Lake Placid, New York, 14 pages (Oct. 1, 1921).

Cohen et al., "Electroplating of Cyclic Multilayered Alloy (CMA) Coatings," J. Electrochem. Soc., vol. 130, No. 10, Oct. 1983, pp. 1987-1995.

Grimmett et al., "Pulsed Electrodeposition of Iron-Nickel Alloys", J. Electrochem. Soc., vol. 137, No. 11, Nov. 1990 3414-3418.

Hariyanti, "Electroplating of Cu—Sn Alloys and Compositionally Modulated Multilayers of Cu—Sn—Zn—Ni Alloys on Mild Steel Substrate," Thesis (Jun. 2007).

Igawa et al., "Fabrication of SiC fiber reinforced SiC composite by chemical vapor infiltration for excellent mechanical properties," Journal of Physics and Chemistry of Solids 66 (2005) 551-554.

Jeong et al., "The Effect of Grain Size on the Wear Properties of Electrodeposited Nanocrystalline Nickel Coatings", Scripta Mater. 44 (2001) 493-499.

Jia et al., "*Liga and Micromolding*" Chapter 4, The MEMS Handbook, 2nd edition, CRC Press, Edited by Mohamed Gad-el-Hak (2006).

Kaneko et al., "Vickers hardness and deformation of Ni/Cu nanomultilayers electrodeposited on copper substrates," Eleventh International Conference on Intergranular and Interphase Boundaries 2004, Journal of Material Science, 40 (2005) 3231-3236.

Karimpoor et al., "Tensile Properties of Bulk Nanocrystalline Hexagonal Cobalt Electrodeposits", Materials Science Forum, vols. 386-388 (2002) pp. 415-420.

(56) References Cited

OTHER PUBLICATIONS

Kockar et al., "Effect of potantiostatic waveforms on properties of electrodeposited NiFe alloy films," Eur. Phys. J. B, 42, 497-501 (2004).
Lashmore et al., "Electrodeposited Multilayer Metallic Coatings", Encyclopedia of Materials Science and Engineering, Supp. vol. 1, 1998, 136-140.
Leisner et al., "Methods for electrodepositing composition-modulated alloys," Journal of Materials Processing Technology 58 (1996) 39-44.
Lewis et al., "Stability in thin film multilayers and microlaminates: the role of free energy, structure, and orientation at interfaces and grain boundaries", Scripta Materialia 48 (2003) 1079-1085.
Low et al., "Electrodeposition of composite coatings containing nanoparticles in a metal deposit," Surface & Coatings Technology 201 (2006) 371-383.
"Low-temperature iron plating," web blog article found at http://blog.sina.com.cn/s/blog_48ed0a9c01100024z.html (published Mar. 22, 2006) (English translation attached).
Marchese, "Stress Reduction of Electrodeposited Nickel," Journal of the Electrochemical Society, vol. 99, No. 2, Feb. 1, 1952, p. 39-43.
Meng et al., "Fractography, elastic modulus, and oxidation resistance of Novel metal-intermetallic $Ni/Ni_3Al$ multilayer films," J. Mater. Res., vol. 17, No. 4, Apr. 2002, 790-796.
Naslain et al., "Synthesis of highly tailored ceramic matrix composites by pressure-pulsed CVI," Solid State Ionics 141-142 (2001) 541-548.
Naslain, "The design of the fibre-matrix interfacial zone in ceramic matrix composites," Composites Part A 29A (1998) 1145-1155.
Nicholls, "Advances in Coating Design for High-Performance Gas Turbines", MRS Bulletin, Sep. 2003, 659-670.
Pilone et al., "Model of Multiple Metal Electrodeposition in Porous Electrodes," Journal of the Electrochemical Society, 153 (5) D85-D90 (2006).
Podlaha et al. "Induced Codeposition : 1. An Experimental Investigation of Ni—Mo Alloys," J. Electrochem. Soc., 143(3):885-892 (1996).
Ross, "Electrodeposited Multilayer Thin Films," *Annual Review of Materials Science*, 24:159-187 (1994).
Sartwell et al., "Replacement of Chromium Electroplating on Gas Turbine Engine Components Using Thermal Spray Coatings", Naval Research Laboratory, Jul. 20, 2005, 207 pages.
Schwartz, "Multiple-Layer Alloy Plating", ASM Handbook, vol. 5: Surface Engineering, 1994, 274-276.
Sherik, "Synthesis, Structure and Properties of Electrodeposited Bulk Nanocrystalline Nickel", Thesis, 1993, 176 pages.
Sperling et al., "Correlation of stress state and nanohardness via heat treatment of nickel-aluminide multilayer thin films", J. Mater. Res., vol. 19, No. 11, Nov. 2004, 3374-3381.
Switzer et al., "Electrodeposited Ceramic Superlattices," Science, vol. 247 (Jan. 26, 1990) 444-446.
Tench et al., "Considerations in Electrodeposition of Compositionally Modulated Alloys," J. Electrochem. Soc. vol. 137, No. 10, Oct. 1990, pp. 3061-3066.
Vill et al., "Mechanical Properties of Tough Multiscalar Microlaminates," Acta metal. mater. vol. 43, No. 2, pp. 427-437, 1995.
Weil et al., "Pulsed electrodeposition of layered brass structures", Metallurgical and Materials Transactions, vol. 19, No. 6, Jun. 1, 1988, 1569-1573.
Yahalom et al., "Formation of composition-modulated alloys by electrodeposition," Journal of Materials Science 22 (1987) 499-503.
Yang et al., "Effects of SiC sub-layer on mechanical properties of Tyranno-SA/SiC composites with multiple interlayers," Ceramics International 31 (2005) 525-531.
Yang et al., "Enhanced elastic modulus in composition-modulated gold-nickel and copper-palladium foils," Journal of Applied Physics, vol. 48, No. 3, Mar. 1977, 876-879.
Zabludovsky et al., "The Obtaining of Cobalt Multilayers by Programme-Controlled Pulse Current," Transactions of the Institute of Metal Finishing, Maney Publishing, Birmingham, GB, vol. 75, Part 05, Sep. 1, 1997, p. 203-204.
Aizenberg et al., "Skeleton of *Euplectella* sp.: Structural Hierarchy from the Nanoscale to the Macroscale," *Science 309*:275-278, 2005.
Bartlett et al., "Electrochemical deposition of macroporous platinum, palladium and cobalt films using polystyrene latex sphere templates," *Chem. Commun*., pp. 1671-1672, 2000.
Cowles, "High cycle fatigue in aircraft gas turbines—an industry perspective," *International Journal of Fracture 80*(2-3):147-163, 1996.
Gasser et al., "Materials Design for Acoustic Liners: an Example of Tailored Multifunctional Materials," *Advanced Engineering Materials 6*(1-2):97-102, 2004.
Ghanem et al., "A double templated electrodeposition method for the fabrication of arrays of metal nanodots," *Electrochemistry Communications 6*:447-453, 2004.
Keckes et al., "Cell-wall recovery after irreversible deformation of wood," *Nature Materials 2*:810-814, 2003.
Lekka et al., "Corrosion and wear resistant electrodeposited composite coatings," Electrochimica Acta. 50:4551-4556, 2005.
Sanders et al., "Mechanics of hollow sphere foams," *Materials Science and Engineering A347*:70-85, 2003.
Suresh, "Graded Materials for Resistance to Contact Deformation and Damage," *Science 292*:2447-2451, 2001.
Voevodin et al., "Superhard, functionally gradient, nanolayered and nanocomposite diamond-like carbon coatings for wear protection," *Diamond and Related Materials 7*:463-467, 1998.
Wu et al., "Preparation and characterization of superhard $CN_x/ZrN$ multilayers," *J. Vac. Sci. Technol. A 15*(3):946-950, 1997.

Figure 2 Panel A
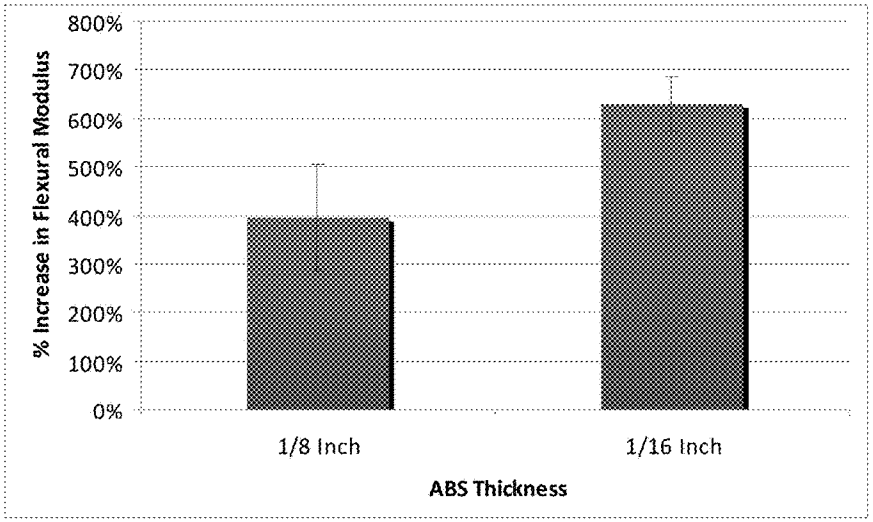
Panel B
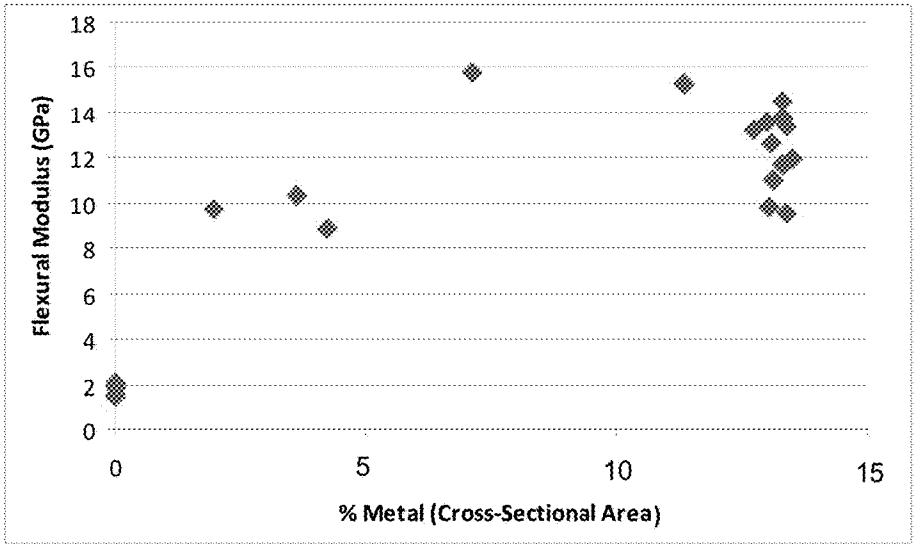

Figure 3 Panel A
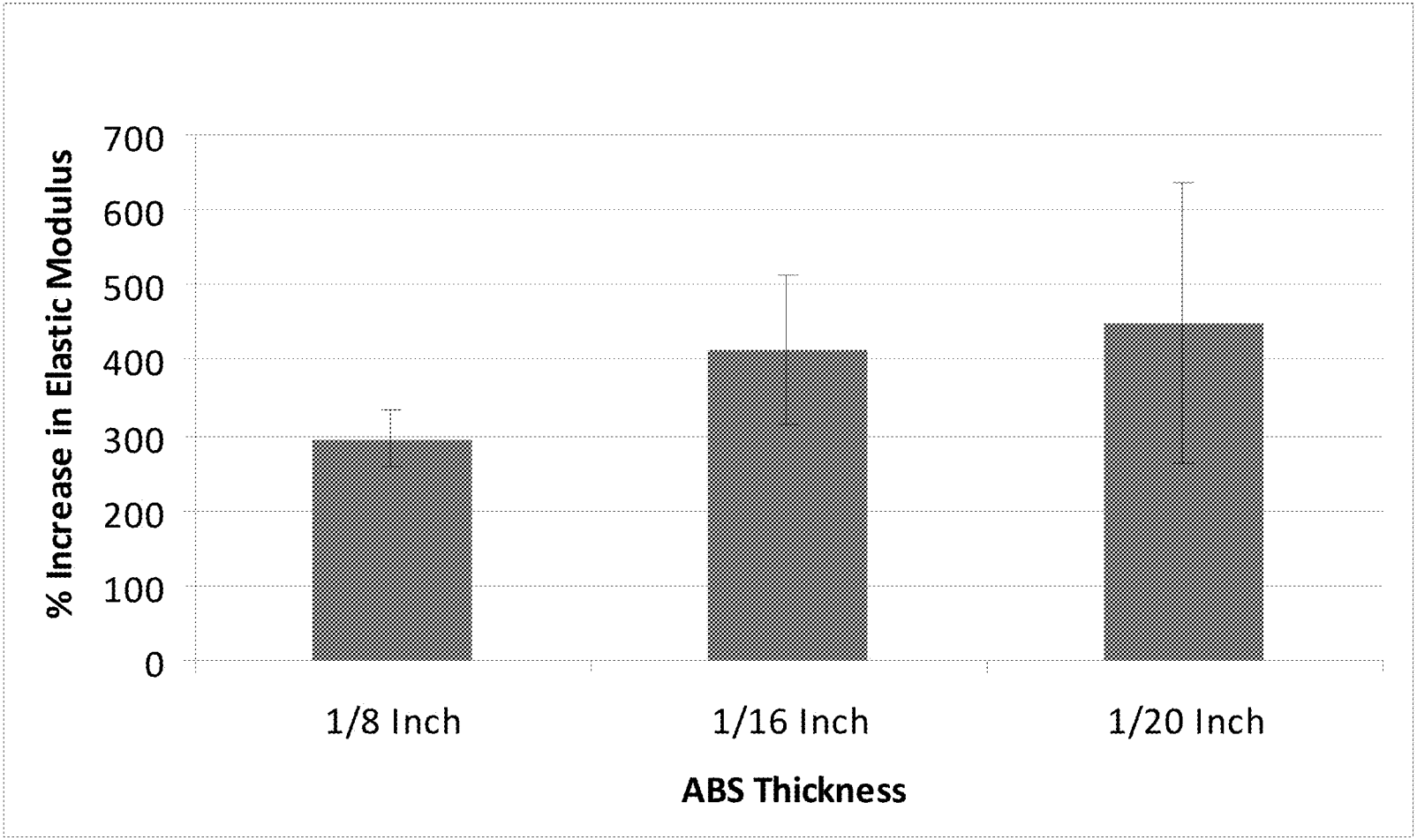

Figure 3 Panel B
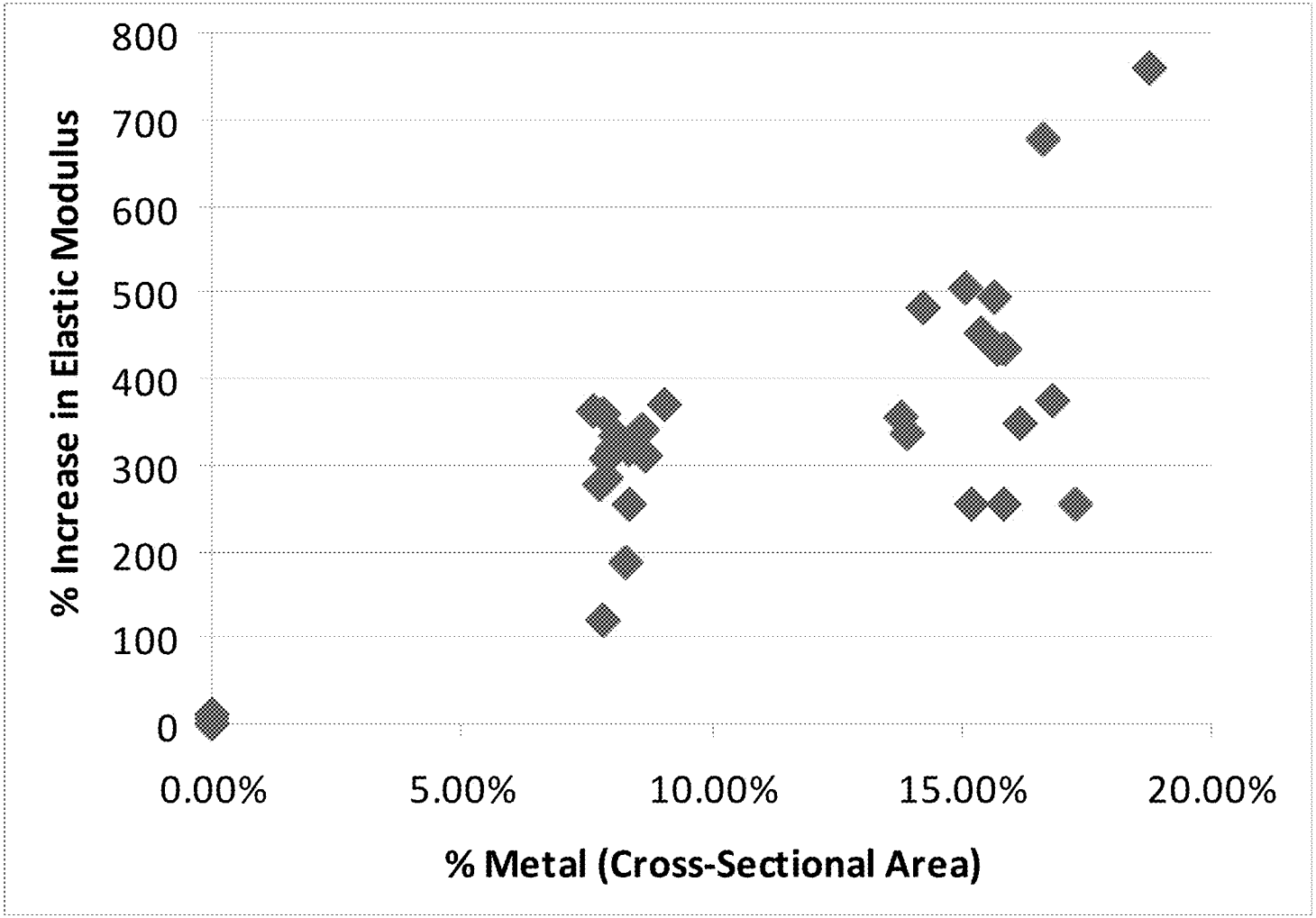

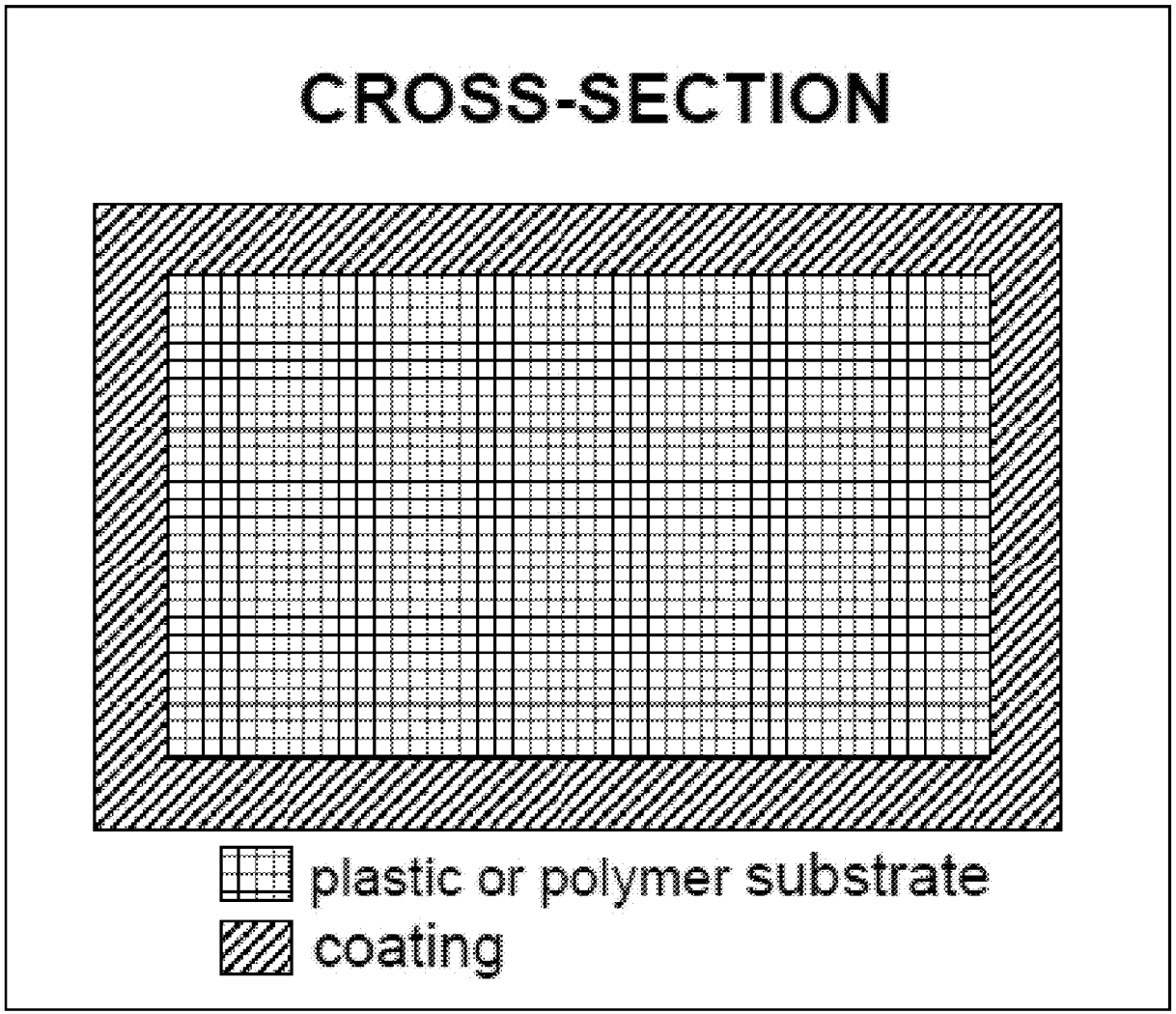
Figure 3 Panel C

MATERIAL AND PROCESS FOR ELECTROCHEMICAL DEPOSITION OF NANOLAMINATED BRASS ALLOYS

TECHNICAL FIELD

This disclosure relates generally to electrodeposition processes, including electrodeposition processes that are suitable for use in the fabrication of coatings and claddings made of brass alloys that exhibit high stiffness and tensile strength.

SUMMARY

Embodiments of this disclosure provide an electrodeposition process for forming an article, or a coating or cladding that is non-toxic or less toxic than coatings or claddings formed with toxic materials such as nickel, chromium, and alloys thereof.

Other embodiments of this disclosure provide an electrodeposition process that forms a deposited layered brass alloy having high stiffness and a high modulus of elasticity.

Other embodiments of this disclosure provide nanolaminated brass coatings on a plastic or polymeric substrate that have an ultimate tensile strength, flexural modulus, modulus of elasticity, and/or stiffness ratio that is greater than the ultimate tensile strength, flexural modulus, modulus of elasticity, and/or stiffness ratio of said conductive plastic or polymeric substrate upon which has been electrodeposited a homogenous brass coating having a thickness and composition substantially equivalent to the thickness and composition of the nanolaminated brass coating. Other embodiments describe methods for the preparation of those coatings.

Other embodiments provide an electrodeposition process that is useful for depositing a nanolaminated brass alloy coating onto a plastic or polymeric substrate at about 100 microns thick. Such coatings are useful for reinforcing plastic or polymeric substrates.

Other embodiments provide a layered brass alloy (coating) formed using an electrodeposition layering process. Where the layered brass alloy is formed on a mandrel from which it can be separated, the layered brass alloy or coating can be an article or a component of an article independent of the mandrel upon which it was formed.

Other embodiments provide an article (e.g., part) having a coating or cladding made of an electrodeposited layered brass alloy, including a coating or cladding deposited onto a plastic or polymeric substrate.

Other embodiments provide a coating or cladding that provides a protective barrier between an underlying substrate or object and an external environment or a person, serving to protect the person or environment from potential damage caused by, or a toxic property of, the substrate or object.

Other embodiments provide a coating or cladding that provides a protective barrier between an underlying substrate or object and an external environment or a person, serving to protect the substrate or object from damage, a toxic property of the external environment, wear and tear, or misuse.

Yet other embodiments of this disclosure provide electrodeposition processes that may be carried out at or near ambient temperatures. Such electrodeposition processes produce articles comprising nanolaminated brass components and/or substrates with nanolaminated brass coatings that have an increase in ultimate tensile strength, modulus of elasticity, and/or flexural modulus compared with the same component or coated substrate prepared with a homogeneous brass alloy having the same composition as the nanolaminated brass component or coating.

BRIEF DESCRIPTION OF THE DRAWINGS

FIG. 2, Panel A, shows a histogram of the increase in flexural modulus observed for ⅛ inch and 1/16 inch thick ABS (acrylonitrile butadiene styrene) samples coated with a nanolaminated brass coating relative to uncoated ABS samples. Panel B shows a scatter plot of Flexural modulus versus the percent of metal based on the fraction of sample cross-sectional area occupied by the nanolaminate brass coating.

FIG. 3, Panel A, shows a histogram of the increase in elastic modulus observed for ⅛, 1/16, and 1/20 inch thick ABS samples coated with a 100 micron thick nanolaminated brass coating. The increase is shown relative to uncoated ABS samples. Panel B of FIG. 3 shows the increase in elastic modulus for coated ABS samples (relative to uncoated ABS sample) as a function of the fraction of cross-sectional area of the coated ABS sample that is occupied by the nanolaminated brass coating applied to ABS samples. FIG. 3, Panel C, shows a cross section (in this case shown for a rectangular substrate) indicating the location of the polymer substrate and nanolaminated coating from which the fraction of the total cross-sectional area occupied by the coating can be calculated (not to scale).

DESCRIPTION OF EMBODIMENTS

Figure 1:
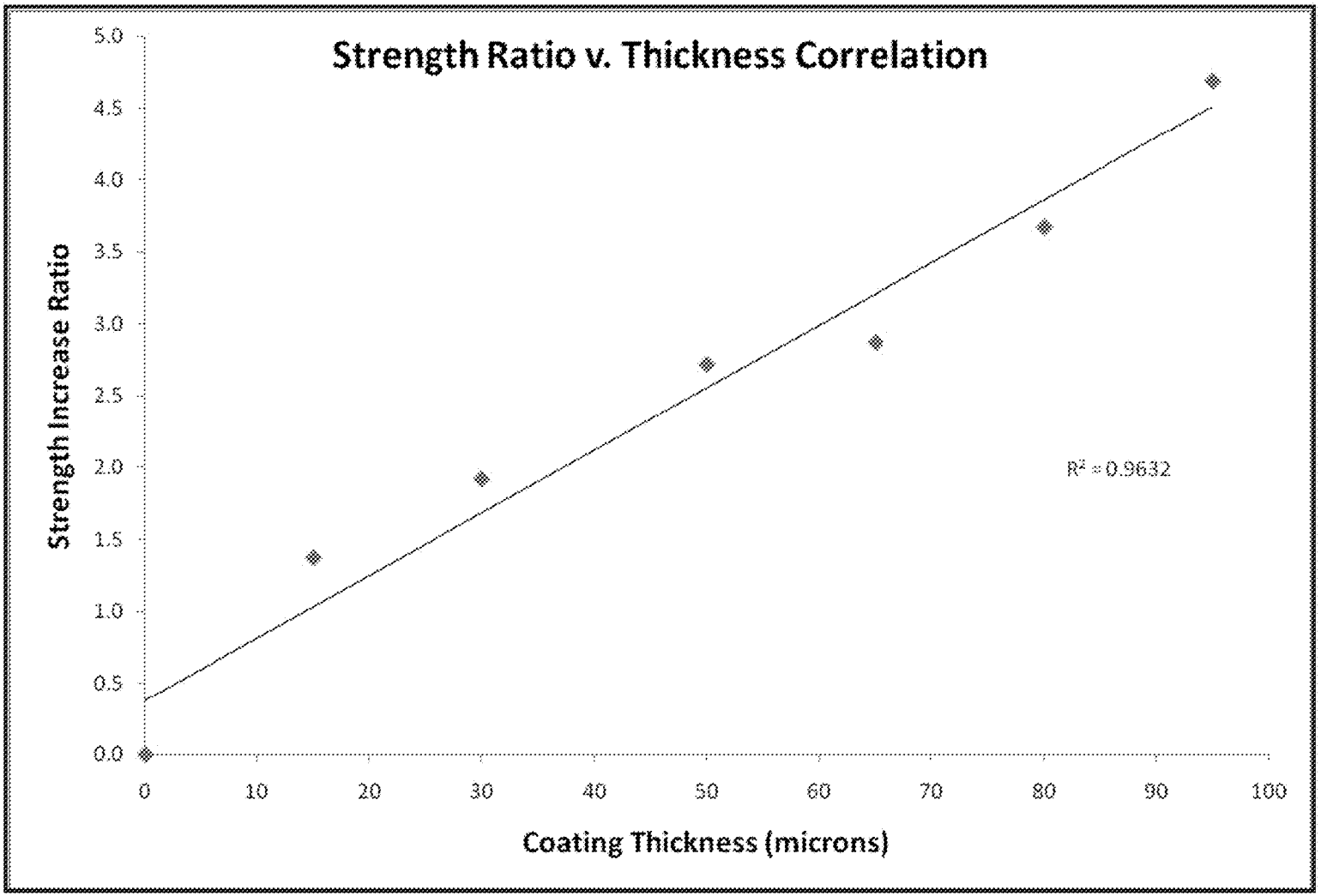
FIG. 1 shows a strength ratio versus thickness correlation for a nanolaminated brass coating on a plastic substrate compared to an uncoated plastic substrate.

Electrodeposition provides a process for forming a thin coating or cladding that can reinforce or protect an underlying substrate or base component, and for forming a part or component with a coating or cladding. It has been found that an electrodeposited brass coating or cladding provides satisfactory reinforcement and protective properties, and that those properties are further enhanced when the electrodeposition forms a layered structure having multiple nanoscale layers that periodically vary in electrodeposited species or electrodeposited species microstructures. Electrodeposition also provides a process for forming (e.g., electroforming) an article comprising a component or electroforming a component, such as on a mandrel, from which it can be removed.

As a process, the use of electrodeposition to form articles/components and/or coatings having multiple laminated layers or multiple laminated "nanolayers" (i.e., nanolamination) offers a variety of advantages. Nanolamination processes enhance the overall material properties of the bulk material by providing alternating layers of differing compositions on a nano-scale that significantly increases the material properties. The material can be strengthened by controlling grain size within each laminate and by also pinning nanolayers between interfaces of dissimilar compositions. Cracks or faults that arise are forced to propagate across hundreds or thousands of interfaces, which hardens and toughens the material by hindering dislocation motion.

In an embodiment of an electrodeposition process, the electrodeposition process involves (a) placing at least a portion of a mandrel or a substrate to be coated in a first electrolyte containing metal ions of zinc and copper, and other metals as desired, (b) applying electric current and varying in time one or more of: the amplitude of the electrical current, the electrolyte temperature, an electrolyte additive concentration, or agitation of the electrolyte to produce periodic layers of electrodeposited species or periodic layers of electrodeposited species microstructures, (c) growing a nanolaminated (multilayer) coating under such conditions, and (d) optionally selectively etching the nanolaminated coating, until the desired thickness and finish of the nanolaminated coating is achieved. That process can further involve (e) removing the mandrel or the substrate from the bath and rinsing.

Electrodeposition can be conducted on a plastic or polymeric substrate that has been rendered conductive. In one embodiment, a plastic or polymeric substrate is rendered conductive by electroless metal deposition. Thus, for example, electroless copper can be applied to a plastic such as a polyamide plastic substrate in order to render the polyamide substrate conductive for subsequent electrodeposition processes. In one embodiment, electroless copper can be applied as a 2-3 micron layer onto a polymer frame. In other embodiments, non-conductive substrates such as plastic or polymeric substrates can be made conductive by application of any suitable metal by electroless processes including, but not limited to, electroless application of: nickel (see, e.g., U.S. Pat. No. 6,800,121), platinum, silver, zinc or tin.

In other embodiments a substrate formed from a non-conductive plastic or polymeric substance can be rendered conductive by the incorporation of conductive materials, such as graphite, into the plastic or polymeric composition (see, e.g., U.S. Pat. No. 4,592,808 for graphite reinforced epoxy composites).

Where necessary or desirable, substrates, and particularly plastic substrates, may be roughened to increase the adherence and/or peel resistance. Roughening may be accomplished by any relevant means including abrading the surface by sanding or sandblasting. Alternatively, surfaces, and particularly plastic surfaces, may be etched with various acids, or bases. In addition, etching processes using ozone (see e.g., U.S. Pat. No. 4,422,907), or vapor-phase sulphonation processes may be employed.

In one embodiment, where electrodeposition is to be conducted on a plastic or polymeric substrate, the plastic or polymeric substrate may comprise one or more of: ABS, ABS/polyamide blend, ABS/polycarbonate blend, a polyamide, a polyethyleneimine, a poly ether ketone, a polyether ether ketone, a poly aryl ether ketone, an epoxy, an epoxy blend, a polyethylene, a polycarbonate or mixtures thereof. In an embodiment, the process involves the electrodeposition of a layered zinc and copper alloy (brass alloy) onto a plastic substrate. The process involves first providing a basic electrolyte containing a copper salt and a zinc salt. The electrolyte can be a cyanide-containing electrochemical deposition bath. Next, a conductive polymeric substrate, upon which zinc, copper, and alloys thereof may be electrodeposited is provided, and at least a portion of the substrate is immersed in the electrolyte. A varying electric current is then passed through the immersed portion of the substrate. The electric current is controlled between a first electrical current that is effective to electrodeposit an alloy that has a specific concentration of zinc and copper and another electrical current that is effective to electrodeposit another alloy of zinc and copper. This varying electrical current may be repeated or additional electrical currents that are effective to electrodeposit other alloys of zinc and copper may be applied. The varying electric currents thereby produce a layered alloy having adjacent layers of different brass alloys on the immersed surface of the substrate or mandrel. A finishing waveform, which may include a reverse pulse, may be introduced in order to improve the surface finish as well as change the relative alloy composition at the surface.

In another embodiment, the electric current may be controlled between a first sequence of electrical pulses that is effective to electrodeposit an alloy that has a specific concentration of zinc and copper and a specific roughness, and another series of electrical pulses that is effective to electrodeposit another alloy of zinc and copper and a specific roughness. These distinct pulse sequences may be repeated to produce an electrodeposit with overall thickness that is greater than 5 microns. Any of the distinct sequences of electric pulses may include a reverse pulse that serves to reduce the surface roughness, to reactivate the surface of the electrodeposit or to permit the deposition of a brass laminate with thickness greater than 5 microns and with a substantially smooth surface.

In another embodiment, a process of electrodepositing multiple layers of brass as an article or component of an article (e.g., formed on a mandrel) or as a coating comprises: (a) providing a mandrel or a plastic or polymeric substrate treated to render it a conductive plastic or polymeric substrate; (b) contacting at least a portion of the mandrel or the conductive plastic or polymeric substrate with an electrolyte containing metal ions of zinc and copper, and optionally containing additional metal ions , wherein said conductive media is in contact with an anode; and (c) applying an electric current across the mandrel or the plastic or polymeric substrate and the anode and varying in time one or more of: the amplitude of the electrical current, electrolyte temperature, electrolyte additive concentration, or electrolyte agitation, in order to produce the nanolaminated brass coating having a desired thickness and periodic layers of electrodeposited species and/or periodic layers of electrodeposited species microstructures on the mandrel or as a coating on the plastic or polymeric substrate.

The electrodeposition can be controlled by, among other things, the application of current in the electrodeposition process. The current may be applied continuously or, alternatively, according to a predetermined pattern such as a waveform. In particular, the waveform (e.g., sine waves, square waves, sawtooth waves, or triangle waves) may be applied intermittently to promote the electrodeposition process, to intermittently reverse the electrodeposition process, to increase or decrease the rate of deposition, to alter the composition of the material being deposited, and/or to provide for a combination of such techniques to achieve a specific layer thickness or a specific pattern of differing layers. The current density (or the voltage use for plating) and the period of the waveforms may be varied independently and need not remain constant during the plating of different layers, but may be increased or decreased for the deposition of different layers. For example, current density may be continuously or discretely varied within the range between 0.5 and 2000 mA/cm$^2$. Other ranges for current densities are also possible, for example, a current density may be varied within the range between: about 1 and 20 mA/cm$^2$, about 5 and 50 mA/cm$^2$, about 30 and 70 mA/cm$^2$, 1 and 25 mA/cm$^2$, 25 and 50 mA/cm$^2$, 50 and 75 mA/cm$^2$, 75 and 100 mA/cm$^2$, 100 and 150 mA/cm$^2$, 150 and 200 mA/cm$^2$, 200 and 300 mA/cm$^2$, 300 and 400 mA/cm$^2$, 400 and 500 mA/cm$^2$, 500 and 750 mA/cm$^2$, 750 and 1000 mA/cm$^2$, 1000 and 1250 mA/cm$^2$, 1250 and 1500 mA/cm$^2$, 1500 and 1750 mA/cm$^2$, 1750 and 2000 mA/cm$^2$, 0.5 and 500 mA/cm$^2$, 100 and 2000 mA/cm$^2$, greater than about 500 mA/cm$^2$, and about 15 and 40 mA/cm$^2$ based on the surface area of the substrate or mandrel to be coated. In another example, the frequency of the waveforms may be from about 0.01 Hz to about 50 Hz. In yet other examples, the frequency can be from: about 0.5 to about 10 Hz, 0.5 to 10 Hz, 10 to 20 Hz, 20 to 30 Hz, 30 to 40 Hz, 40 to 50 Hz, 0.02 to about 1 Hz, about 2 to 20 Hz, or about 1 to about 5 Hz. In one embodiment the method used to prepare the nanolaminated brass coatings on a mandrel or plastic or polymeric substrate comprises (i) applying a first cathodic current density of about 35 to about 47 mA/cm$^2$ for a time from about 1 to 3 sec followed by (ii) a rest period of about 0.1 to about 5 seconds; and repeating (i) and (ii) for a total time from about 2 minutes to 20 minutes. Following the application of the first cathodic current, the method continues with the steps of (iii) applying a second cathodic current from about 5 to 40 mA/cm$^2$ for about 3 to about 18 seconds, followed by (iv) applying a third cathodic current of about 75 to about 300 mA/cm$^2$ for about 0.2 to about 2 second, which is followed by (v) an anodic current about −75 to about −300 mA/cm$^2$ for about 0.1 to about 1 second; and repeating (iii) to (v) for time from about 3 to about 9 hours. The process may be repeated to obtain multiple layers of nanolaminated brass coatings. For example by repeating steps (i)-(v) as described above.

The electrical potential may also be varied to control layering and the composition of individual layers. For example, an electrical potential employed to prepare the coatings may be in the range of 0.5 V and 20 V. In another example, the electrical potential may be within a range selected from 1 V to 20 V, 0.50 to 5 V, 5 to 10 V, 10 to 15 V, 15 to 20 V, 2 to 3 V, 3 to 5 V, 4 V to 6 V, 2.5V to 7.5 V, 0.75 to 5 V, 1 V to 4 V, and 2 to 5 V.

In an embodiment, of the coating or cladding, an electrodeposited, layered brass alloy is formed to have multiple nanoscale layers that periodically vary in electrodeposited species or electrodeposited microstructures, with variations in the layers of electrodeposited species or electrodeposited species microstructure providing a material with high modulus of elasticity. Another embodiment provides an electrodeposition process that forms a laminated brass alloy that varies in the concentration of alloying elements from layer-to-layer. Yet another embodiment is an electrodeposited, nanolaminated brass alloy coating or bulk material having multiple nanoscale layers that vary in electrodeposited species microstructure with layer variations resulting in a material with a high modulus of elasticity.

In another embodiment, a nanolaminated component or coating having a plurality of layers of brass alloys is provided. The layers are of the same thickness or of different thicknesses. Each of the layers, referred to herein as nanoscale layers and/or periodic layers, has a thickness of from approximately 2 nm to approximately 2,000 nm.

In one embodiment, a brass component comprised of nanolaminated brass exhibits an ultimate tensile strength that is at least 10%, 20% or 30% greater than a brass component formed from a homogeneous brass alloy that has a composition substantially equivalent to the composition of said nanolaminated brass coating.

In another embodiment, a plastic or polymeric substrate, or a portion thereof, can be coated with a nanolaminated brass coating. The coated substrate is stronger than the uncoated substrate or the substrate when coated with a homogeneous brass alloy that has a thickness and composition substantially equivalent to (or equivalent to) the thickness and composition of the nanolaminated brass coating. In some embodiments the ultimate tensile strength of the coated plastic or polymeric substrate is increased by greater than 10, 20, or 30% relative to the homogeneously coated plastic or polymeric substrate. In other embodiments the ultimate tensile strength of the coated plastic or polymeric substrate is increased by greater than 100%, 200%, 300%, 400% or 500% relative to the uncoated plastic or polymeric substrate.

In one embodiment, a nanolaminated brass coating present on a plastic or polymeric substrate exhibit more than a three-fold increase in flexural modulus relative to said plastic or polymeric substrate without said coating, when the nanolaminated brass coating has a cross-sectional area of 5% of the total cross-sectional area of the coated substrate. In another embodiment, a nanolaminated brass coating present on a plastic or polymeric substrate provides more than a four-fold increase in flexural modulus relative to the plastic or polymeric substrate without the coating, when the nanolaminated brass coating has a cross-sectional area of 10%.

In other embodiments, components comprised of nanolaminated brass have a modulus of elasticity greater than about 60, 65, 70, 75, 80, 90, 100, 110, 120, 130, 140, 150, 160, 180, 200, 220, 240, 250, or 300 GPa. In another embodiment, the nanolaminated brass coating has a modulus of elasticity greater than 60, 65, 70, 75, 80, 90, 100, 110, 120, 130, 140, 150, 160, 180, 200, 220, 240, 250, or 300 GPa. In another embodiment, the nanolaminated brass component or the nanolaminated brass coating has a modulus of elasticity expressed in giga Pascals (GPa) from about 60 to about 100, or from about 80 to about 120, or from about 100 to about 140, or from about 120 to about 140, or from about 130 to about 170, or from about 140 to about 200, or from about 150 to about 225, or from about 175 to about 250, or from about 200 to about 300 GPa.

In one embodiment, the coating increases the stiffness of a plastic or polymeric substrate. In such an embodiment, relative to an uncoated substrate, a nanolaminated brass-coated plastic or polymeric substrate exhibits more than about a 2.8-fold increase in stiffness when the nanolaminated brass coating has a cross-sectional area of about 10% of the total cross-sectional area of the coated substrate. In another embodiment, a more than 4-fold increase in stiffness is observed when said coating has a cross-sectional area of about 15% of the total cross-sectional area of the coated substrate. In another embodiment, a more than 7-fold increase in stiffness is observed when said coating has a cross-sectional area of about 20% of the total cross-sectional area of the coated substrate.

In one embodiment, where a nanolaminated brass coating is present on at least a portion of a surface of a plastic or polymeric substrate, the article, or the portion of the article bearing the coating, exhibits an ultimate tensile strength that is at least 267% greater than the uncoated substrate. In another embodiment, the article is a nanolaminated brass-coated plastic or polymeric substrate that exhibits an ultimate tensile strength that is at least 30% greater than the ultimate tensile strength of the plastic or polymeric substrate coated with a homogeneous brass alloy that has a thickness and composition substantially equivalent to the thickness and composition of said nanolaminated brass coating.

As used herein a thickness is substantially equivalent to one or more other thickness(es) if it is with the range from 95% to 105% of the one or more other thickness(es).

As used herein, a composition is substantially equivalent to a nanolaminated brass coating composition when (i) it contains all of the components of the nanolaminate brass coating that are present at more than 0.05 weight percent (i.e., 0.5% based on the weight of the nanolaminate coating) and (ii) each said component is present in an amount that is from 95% to 105% of the weight percent appearing in the nanolaminate brass coating. For example, if a component of a nanolaminate coating is present at about 2% by weight (based on the weight and composition of all layers of the nanolaminate coating) then in an equivalent composition (e.g., a homogeneous coating) the component would be required to be present in an amount from 1.9% to 2.1% by weight.

The electrodeposition process can be controlled to selectively apply coating to only portions of the substrate. For example, a masking product can be applied with a brush or application technique to cover portions of the substrate to prevent coating during a subsequent electrodeposition process.

Embodiments of the method can be conducted at or near ambient temperatures, i.e., temperatures of approximately 20 degrees C., to temperatures of approximately 155 degrees C. Conducting the electrodeposition of the nanolaminated coating at or near ambient temperatures reduces the likelihood of introducing flaws as a result of temperature-related deformation of a polymeric substrate or mandrel onto which the alloy is deposited.

As used herein, "metal" means any metal, metal alloy or other composite containing a metal. In an example, these metals may comprise one or more of Ni, Zn, Fe, Cu, Au, Ag, Pt, Pd, Sn, Mn, Co, Pb, Al, Ti, Mg, and Cr. When metals are deposited, the percentage of each metal may independently be selected. Individual metals may be present at about 0.001, 0.005, 0.01, 0.05, 0.1, 0.5, 1, 5, 10, 15, 20, 25, 30, 30, 35, 40, 45, 50, 55, 60, 65, 70, 75, 80, 85, 90, 95, 98, 99, 99.9, 99.99, 99.999, or 100 percent of the electrodeposited species/composition.

The nanolaminated brass described herein comprises layers (periodic layers) with a zinc content that varies between 1% and 90% and a copper content that varies between 10 and 90% on a weight basis. In one embodiment, at least one of the periodic layers comprises a brass alloy with a zinc concentration that varies between 1% and 90%. In another embodiment, at least half of the periodic layers comprise a brass alloy with a zinc concentration that varies between 1% and 90%. In another embodiment, all of the periodic layers comprise a brass alloy with a zinc concentration that varies between 1% and 90%. In one embodiment, the zinc content is about 50% to about 68%, about 72% to about 80%, about 60% to about 80%, about 65% to about 75%, about 66% to about 74%, about 68% to about 72%, about 60%, about 65%, about 70%, about 75% or about 80% by weight. Where additional metals or metalloids (such as silicon) are present in one or more layers (periodic layers) of said nanolaminated brass articles/components or coatings, the additional metals will typically comprise between 0.01% and 15% of the layer composition by weight. In one embodiment, the total amount of additional metals and/or metalloids is less than 15%, 12%, 10%, 8%, 6%, 5%, 4%, 3%, 2%, 1%, 0.5%, 0.2%, 0.1%, 0.05%, or 0.02% but in each instance greater than about 0.01% by weight.

In an embodiment, the coating can have a coating thickness that varies according to properties of the material that is to be protected by the coating, or according to the environment to which the coating is subjected. In one embodiment the overall thickness of the nanolaminated brass coating (e.g., the desired thickness) is between 10 nanometers and 100,000 nanometers (100 microns), 10 nanometers and 400 nanometers, 50 nanometers and 500 nanometers, 100 nanometers and 1,000 nanometers, 1 micron to 10 microns, 5 microns to 50 microns, 20 microns to 200 microns, 40 microns to 100 microns, 50 microns to 100 microns, 50 microns to 150 microns, 60 microns to 160 microns, 70 microns to 170 microns, 80 microns to 180 microns, 200 microns to 2 millimeters (mm), 400 microns to 4 mm, 200 microns to 5 mm, 1 mm to 6.5 mm, 5 mm to 12.5 mm, 10 mm to 20 mm, and 15 mm to 30 mm.

In an embodiment, the coating is sufficiently thick to provide a surface finish. In one embodiment, the overall thickness of a nanolaminated brass coating on a plastic substrate is between 50 and 90 microns. In another embodiment, the overall thickness of a nanolaminated brass coating on a plastic substrate is between 40 and 100 microns or 40 and 200 microns. The surface finish can be modified by polishing methods, such as mechanical polishing, electropolishing, and acid exposure. The polishing can be mechanical and remove less than approximately 20 microns from the coating thickness. In one embodiment, the thickness of the brass coating on a plastic or polymeric substrate is less than 100 microns, for example, ranging between 45 and 80 microns across the layers of the coating and, for example, providing an average thickness of 70-80 microns. In one embodiment, the nanolaminated brass coating is polished or electropolished to a surface having an arithmetic average roughness (Ra) less than about 25, 12, 10, 8, 6, 4, 2, 1, 0.5, 0.2, 0.1, 0.05, 0.025, or 0.01 microns. In another embodiment, the average surface roughness is less than about 4, 2, 1, 0.5, 0.2, 0.1, 0.05, 0.025, or 0.01 microns. In another embodiment, the average surface roughness is less than about 2, 1, 0.5, 0.2, 0.1, or 0.05 microns Nanolaminated brass coatings, articles or components of articles may contain any number of desired layers (e.g., 2 to 100,000 layers) of suitable thickness. In some embodiments the coatings will comprise 2, 3, 4, 5, 6, 7, 8, 9, 10, 12, 14, 16, 18, 20, 22, 24, 26, 28, 30, 35, 40, 45, 50, 60, 70, 80, 90, 100, 150, 200, 250, 300, 350, 400, 450, 500, 600, 700, 800, 900, 1,000, 1,500, 2,000, 2,500, 3,000, 4,000, 5,000, 7,500, 1,000, 2,000, 4,000, 6,000, 8,000, 10,000, 20,000, 40,000, 60,000, 80,000, or 100,000 or more layers of electrodeposited materials, where each layer may be from about 2 nm-2,000nm (2 microns). In some embodiments, the individual layers have a thickness from about 2 nm-10 nm, 5 nm-15 nm, 10 nm -20 nm, 15 nm-30 nm, 20 nm-40 nm, 30 nm-50 nm, 40 nm-60 nm, 50 nm-70 nm, 50 nm-75nm, 75 nm-100 nm, 5 nm-30 nm, 15 nm-50 nm, 25 nm-75 nm, or 5 nm-100 nm. In other embodiments, the individual layers have a thickness of about 2 nm to 1,000 nm, or 5 nm to 200 nm, or 10 nm to 200 nm, or 20 nm to 200 nm, 30 nm to 200 nm, or 40 nm to 200 nm, or 50 nm to 200 nm.

Nanolaminated brass coatings, articles, or components of articles, may contain a series of layers that may be organized in a variety of ways. In some embodiments, layers that differ from each other in the electrodeposited species (metal and/or metalloid composition) and/or the microstructure of the electrodeposited species are deposited in repeated patterns. Although a type of layer may recur more than once in a coating or article, the thickness of that type of layer may or may not be the same in each instance where it appears. Nanolaminated brass coatings, articles, or components of articles may comprise two, three, four, five or more types of layers that may or may not repeat in a specific pattern.

By way of non-limiting example, layers designated a, b, c, d, and e that differ in the electrodeposited species (metal and/or metalloid composition) and/or the microstructure of the electrodeposited species may be organized in an alternating pattern such as a binary (a,b,a,b,a,b,a,b, . . . ), ternary (a,b,c,a,b,c,a,b,c,a,b,c, . . . ), quaternary (a,b,c,d,a,b,c,d,a,b,c,d,a,b,c,d, . . . ), quinary (a,b,c,d,e,a,b,c,d,e,a,b,c,d,e,a,b,c,d,e, . . . ) and so on. Other arrangements are also possible such as (c,a,b,a,b,c,a,b,a,b,c, . . . ), (c,a,b,a,b,e,c,a,b,a,b,e, . . . ) etc.

In some embodiments the nanolaminated brass prepared by the methods of electrodeposition described herein comprises 2, 3, 4, 5, or 6 or more layers of different composition having different electrodeposited species and/or different amounts of electrodeposited species. In some embodiments the nanolaminated brass prepared by the methods of electrodeposition described herein comprises 2, 3, 4, 5, 6 or more layers with different microstructures.

In other embodiments, the nanolaminated brass comprises a combination of different layers that have different compositions and different microstructures. Thus, for example, in some embodiments, the nanolaminated brass coatings and components prepared as described herein have a first layer and contain (i) at least one layer that differs from the first layer in the amounts/types of electrodeposited species, and (ii) at least one layer that differs from the first layer in microstructure, where the layers differing in electrodeposited species and microstructure may be the same or different layers.

In some embodiments, the nanolaminated brass has a first layer and contains (i) at least two layers that differ from the first layer and each other in the amounts and/or types of electrodeposited species, and (ii) at least one layer that differs from the first layer in microstructure. In some embodiments, the nanolaminated brass has a first layer and contains at least (i) one layer that differs from the first layer in the amounts and/or types of electrodeposited species, and (ii) at least two layers that differ from the first layer and each other in microstructure. In other embodiments, the nanolaminated brass has a first layer and contains (i) at least two layers that differ from the first layer, and each other in the amounts and/or types of electrodeposited species, and (ii) at least two layers that differ from the first layer and each other in microstructure. In each instance, the layers differing in electrodeposited species and/or microstructure may be the same or different layers.

In other embodiments, the nanolaminated brass has a first layer and contains (i) at least three layers that differ from the first layer and each other in the amounts and/or types of electrodeposited species, and (ii) at least two layers that differ from the first layer and each other in microstructure. In other embodiments, the nanolaminated brass has a first layer and contains (i) at least two layers that differ from the first layer and each other in the amounts and/or types of electrodeposited species, and (ii) at least three layers that differ from the first layer and each other in microstructure. In other embodiments, the nanolaminated brass has a first layer and contains (i) at least three layers that differ from the first layer and each other in the amounts and/or types of electrodeposited species, and (ii) at least three layers that differ from the first layer and each other in microstructure. In each instance, the layers differing in electrodeposited species and/or microstructure may be the same or different layers In other embodiments, the nanolaminated brass has a first layer and contains (i) at least four layers that differ from the first layer and each other in the amounts and/or types of electrodeposited species, and (ii) at least four layers that differ from the first layer and each other in the first layer in microstructure. In other embodiments, the nanolaminated brass has a first layer and contains (i) at least five layers that differ from the first layer and each other in the amounts and/or types of electrodeposited species, and (ii) at least five layers that differ from the first layer and each other in the first layer in microstructure. In each instance, the layers differing in electrodeposited species and/or microstructure may be the same or different layers

EXAMPLES

Example 1. Nanolaminated Brass Deposition

The following example describes a method for the preparation of an electrodeposited nanolaminated brass coating or cladding that can be deposited on a plastic or polymeric substrate.

Prior to the electrolytic deposition of any metals on the surface of a plastic or polymeric substrate the substrate is electrolessly plated with a commercial electroless nickel (or electroless copper) solution to form a conductive coating typically 2-3 microns thick. The e-nickel coated substrate is then immersed in 50% aqueous saturated HCl (approximately 10.1% HCl) for two minutes or until bubble formation is noted. The substrate is then washed with water.

The substrate is immersed in a commercial cyanide copper-zinc electroplating bath (E-Brite B-150 Bath from Electrochemical Products Inc. (EPI)) comprising CuCN (29.95 g/l), ZnCN (12.733 g/l), free cyanide (14.98 g/l), NaOH (1.498 g/l), $Na_2CO_3$ (59.92 g/l) E-Brite™ B-150 1% by volume, Electrosolv™ 5% by volume, E-Wet™ 0.1% by volume. The pH of the bath ranged from 10.2 to 10.4, temperature for plating was from 90-120 degrees F. The anode to cathode ratio was from 2:1 to 2.6 to 1 with an anode of alloy 260 or Rolled or extruded 70/30 (copper/zinc) brass. Agitation was provided either by cathode movement at 15 ft/minute or by air sparging using a flow rate of 2 cubic feet per minute of air per foot of sparging pipe.

Electrodeposition is commenced by applying a waveform consisting of a 42.2 $mA/cm^2$ pulse held for 1.9 seconds, followed by a 0 $mA/cm^2$ pulse (rest period) applied for 0.25 sec. for a total of 10 minutes. Immediately following the ten minute period where the preceding waveform is applied, a second waveform is applied for 6 hours and 40 minutes, consisting of a 20 $mA/cm^2$ pulse applied for 9 seconds, followed by a 155 $mA/cm^2$ pulse applied for 1 sec, followed by a −155 $mA/cm^2$ stripping (reverse) pulse applied for 0.4 seconds. During electrodeposition the anodes were cleaned as necessary to prevent the passivization of the anodes. Where necessary, anodes were cleaned at two hour intervals, which required pausing the electrodeposition process.

The process applies a nanolaminated brass coating to the substrate having a periodic layers with a thickness of 40 to 50 nm (about 44 nm). The total thickness of the coating was about 100 microns.

Example 2. Tensile Properties of ABS Specimens with and without Nanolaminated Brass Reinforcement Nanolaminated brass-coated polymeric dog bone specimens were tested using ASTM D638. Tensile specimens were prepared by laser-cutting dog bones from acrylonitrile butadiene styrene (ABS) sheet to the geometry specified in the ASTM standard. These substrates were subsequently coated using the method described in Example 1. An Instron Model 4202 test frame was used to conduct the tensile testing.

The resulting ultimate tensile strength results are depicted in FIG. 1, which provides a comparison of ultimate tensile strength increase ratio to coating thickness, and shows that the ultimate tensile strength is directly proportional to coating thickness. In particular, the ultimate tensile strength of the nanolaminated brass-coated part is shown to increase linearly with thickness, at a strong correlation of $R^2$=0.9632. The testing demonstrated that the nanolaminated coating provided a 500% increase in ultimate tensile strength at a 95 micron thickness as compared to the non-coated substrate.

Figure 4:
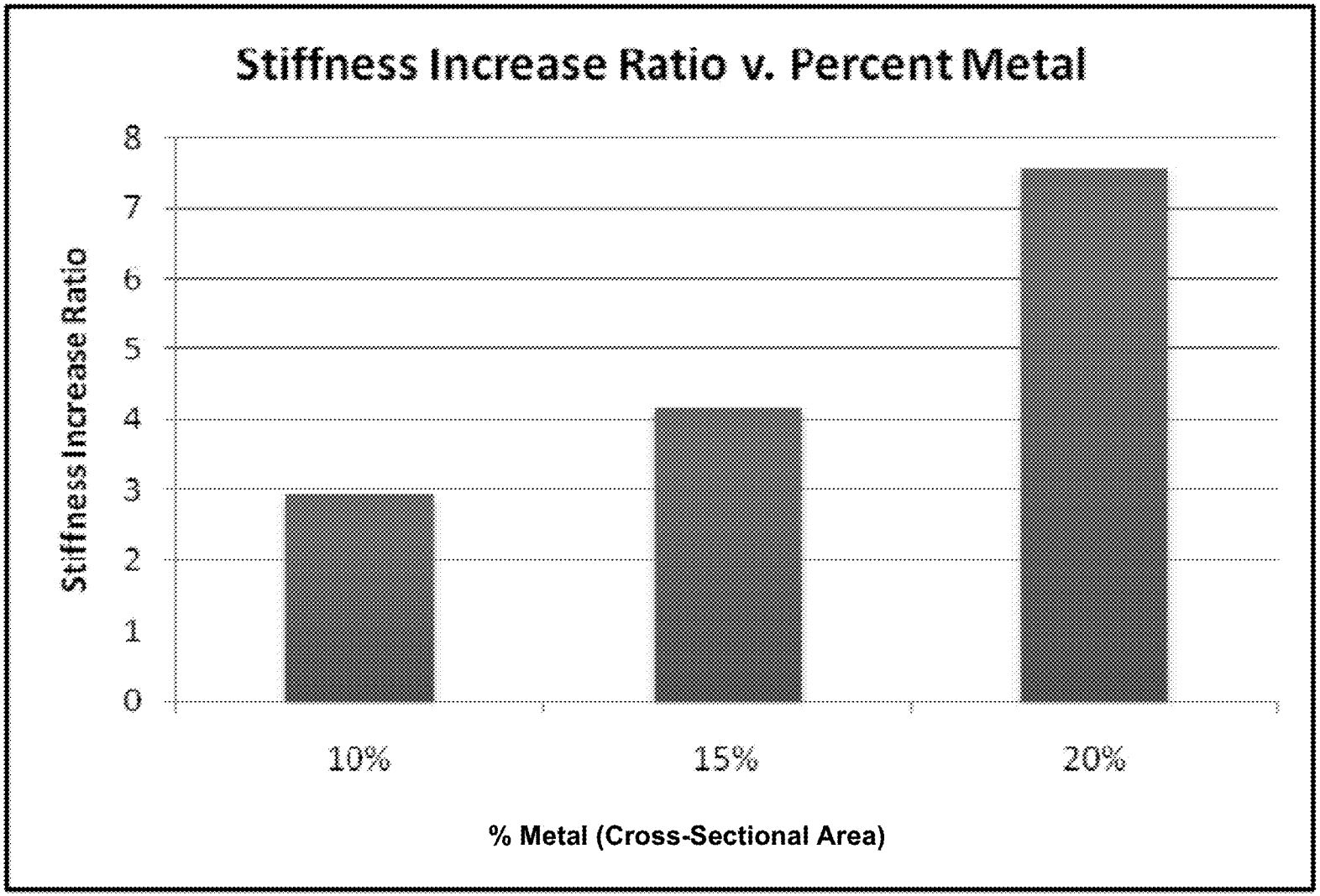
FIG. 4 show a histogram of the increase in stiffness ratio for ABS samples coated with a nanolaminated brass coating relative to uncoated ABS samples. The increase in stiffness ratio is shown for samples having 10%, 15%, or 20% of their cross-sectional area occupied by the nanolaminated brass coating.

Tensile testing also produced elastic modulus (stiffness) data. FIG. 4 presents the improvement in stiffness as a function of coating thickness (expressed as % of metal in cross-section). As illustrated, the nanolaminated coating increases the elastic modulus from approximately 3 to 7-fold when the nanolaminated brass accounts for ~10 to 20% (respectively) of the cross-sectional area of the tensile specimen.

FIG. 3B presents the improvement in elastic modulus expressed as a "stiffness ratio", that is, the ratio of the nanolaminate-coated specimen stiffness to that of an uncoated specimen, again illustrating the 3 to 7-fold increase in stiffness with an increase in nanolaminate cross-section fraction from 10 to 20%.

FIG. 3, Panel A, illustrates the effect of nanolaminated brass on ABS specimens of different thicknesses relative to uncoated ABS specimens. ABS specimens to which a 100 micron nanolaminated brass coating has been applied show at least a 10% increase in the flexural modulus for each 1% of cross-sectional area occupied by the nanolaminated brass coating. The average increases in elastic modulus is greater than about 20% for each 1% of cross-sectional area occupied by the nanolaminated brass coating.

Example 3. Flexural Properties of ABS Specimens with and without Nanolaminated Brass Reinforcement Specimen substrates were cut from ABS sheets of differing thickness (⅛ and 1/16 of an inch) and coated as described in Example 1 with a nanolaminated brass coating 100 microns thick. The flexural modulus was tested according to ASTM D5023. The results are shown in FIG. 2, Panel A, relative to control ABS sheets for which data are provided below. While the elastic modulus of ⅛ inch ABS improved 300%, the flexural modulus was increased by 400%. Similarly, instead of a 400% improvement for 1/16 inch ABS, the flexural modulus increased by over 600%.

Example 4. Fabrication and Bend Testing of Homogeneous, Nanolaminated, and Uncoated Structural Frames To quantify the difference between nanolaminated brass coating and homogeneous brass alloy coating, a control sample, in this case a plastic frame part, was electroplated using a direct current (DC) at a specified average current density. At the completion of a plating period that was sufficient to produce an 80-micron thick nanolaminated brass coating on a part produced in accordance with an embodiment, the DC control plastic frame was coated with only 30 microns of non-laminated brass. This lesser thickness of the control was due to the fact that a DC plating of brass proceeds at a significantly slower plating rate that slows and becomes thickness-limited over the time the plating proceeds. Therefore, a DC-plated homogeneous brass part could not be created at the desired thickness for comparison. Accordingly, a homogeneous (not laminated) brass-coated part was fabricated using a pulse plating technique to achieve the desired thickness of 80 microns, and to provide a homogeneous-coated part for comparison to the part with the 80-micron nanolaminated brass coating.

The homogeneous-coated part having a coating thickness of 80 microns, the part having a nanolaminated brass coating with a thickness of 80 microns, and an uncoated plastic part were evaluated and compared using ASTM D5023, modified to accommodate the unique part geometry. The load results show that, for a constant 0.10 inch deflection, the part coated with nanolaminated brass had an increase of about 270% in ultimate tensile strength relative to the uncoated part, and a 20% increase in ultimate tensile strength relative to the part with the homogenous brass coating. The test results are shown in the following table:

| Sample | Load (lbs) | Percent improvement over uncoated part | Percent improvement over homogeneous-coated part |
|---|---|---|---|
| Uncoated part | 2.0 | — | — |
| Homogeneous brass-coated part | 6.1 | 206% | — |
| Nanolaminated brass-coated part | 7.3 | 267% | 20% |

The load results demonstrate that layer modulation of the nanolaminated coating significantly increases the strength as compared to a homogeneous coating.

We claim:

1. An article, comprising: a nanolaminated brass coating comprising periodic layers of electrodeposited species, microstructures, or both, at least two of the periodic layers independently having thicknesses from about 2 nanometers (nm) to about 200 nm, the nanolaminated brass coating having a first thickness and a first composition, wherein the nanolaminated brass coating has an ultimate tensile strength, a flexural modulus, a modulus of elasticity, a stiffness ratio, or a combination thereof that is greater than an ultimate tensile strength, a flexural modulus, a modulus of elasticity, a stiffness ratio, or a combination thereof of a homogenous brass coating deposited using a direct current with a single current density, the homogenous brass coating having a second thickness that is substantially equivalent to the first thickness and a second composition that is substantially equivalent to the first composition.

2. The article of claim 1, further comprising a mandrel that is separable from the nanolaminated brass coating.

3. The article of claim 1, further comprising a polymeric substrate that has been rendered conductive, the nanolaminated brass coating being on a surface of the polymeric substrate.

4. The article of claim 3, wherein the polymeric substrate comprises glass or mineral fillers, or is reinforced by carbon fiber or glass fiber, or a combination thereof.

5. The article of claim 3, wherein the flexural modulus of the nanolaminated brass coating exhibits about a three-fold increase relative to a flexural modulus of the polymeric substrate without the nanolaminated brass coating, when the nanolaminated brass coating has a cross-sectional area of 5% of a total cross-sectional area of the article.

6. The article of claim 3, where the nanolaminated brass coating exhibits more than about a 2.8 fold increase in stiffness relative to the polymeric substrate without the nanolaminated brass coating, when the nanolaminated brass coating has a cross-sectional area of about 10% of a total cross-sectional area of the article.

7. The article of claim 3, wherein the polymeric substrate comprises a plastic.

8. The article of claim 3, further comprising a layer of a conductive material between the polymeric substrate and the nanolaminated brass coating.

9. The article of claim 1, wherein the second thickness is from about 95% to 105% of the first thickness.

10. The article of claim 1, wherein the nanolaminated brass coating has a surface with an arithmetic average roughness (Ra) of less than about 4 microns.

11. The article of claim 1, wherein the nanolaminated brass coating comprises greater than 200 periodic layers.

12. The article of claim 1, wherein each of the periodic layers has a thickness ranging from about 2 nm to about 2,000 nm.

13. The article of claim 1, wherein the ultimate tensile strength of the nanolaminated brass coating is at least 10% greater than the ultimate tensile strength of the homogeneous brass coating.

14. The article of claim 1, wherein the nanolaminated brass coating has a modulus of elasticity that is greater than 60 GPa.

15. The article of claim 1, wherein the ultimate tensile strength of the nanolaminated brass coating is at least 30% greater than the ultimate tensile strength of the homogeneous brass coating.

16. An article comprising:

a polymeric substrate; and a nanolaminated brass coating on at least a portion of a surface of the polymeric substrate, the nanolaminated brass coating having a desired thickness and comprising periodic layers of (i) electrodeposited species and/or (ii) electrodeposited species microstructures, each of the periodic layers having a thickness ranging from 2 nanometers (nm) to 2,000 nm, at least two of the periodic layers having a thickness ranging from 2 nm to 200 nm, the nanolaminated brass coating comprising more than 50 of the periodic layers.

17. The article of claim 16, wherein the polymeric substrate comprises a non-conductive polymeric substrate that has been rendered conductive.

18. The article of claim 17, wherein the polymeric substrate comprises ABS, ABS/polyamide blend, ABS/polycarbonate blend, a polyamide, a polyethylene imine, a poly ether ketone, a poly ether ether ketone, a poly aryl ether ketone, an epoxy, an epoxy blend, a polyethylene, a polycarbonate, or a combination thereof.

19. The article of claim 16, wherein the polymeric substrate comprises a conductive plastic.

20. The article of claim 16, wherein the nanolaminated brass coating comprises greater than 200 periodic layers.

21. The article of claim 16, wherein each of the periodic layers has a thickness ranging from 2 nm to 200 nm.

22. The article of claim 16, wherein at least two periodic layers differ in thickness by more than 5%.

23. The article of claim 16, wherein at least one of the periodic layers has a zinc concentration ranging from 60% to 80%.

24. The article of claim 16, comprising an outermost layer, the outermost layer comprising a metal or an alloy that is more noble than any of the periodic layers.

25. The article of claim 16, further comprising a layer of a conductive material between the polymeric substrate and the nanolaminated brass coating.

* * * * *